US005194172A

United States Patent [19]

Taneri et al.

[11] Patent Number: 5,194,172

[45] Date of Patent: Mar. 16, 1993

[54] AERATED AND FREEZER BAR SOAP COMPOSITIONS CONTAINING SUCROSE AS A MILDNESS AID AND A PROCESSING AID

[75] Inventors: James E. Taneri, West Chester; Natalie M. Moroney, Loveland, both of Ohio

[73] Assignee: The Procter & Gamble Company, Cincinnati, Ohio

[21] Appl. No.: 582,270

[22] Filed: Sep. 13, 1990

[51] Int. Cl.[5] ..... C11D 9/24; C11D 9/26; C11D 9/48; C11D 13/16

[52] U.S. Cl. ..... 252/130; 252/132; 252/134; 252/174.17; 252/367; 252/368; 252/370; 252/DIG. 5; 252/DIG. 16

[58] Field of Search ..... 252/108, 128, 130, 134, 252/174.17, DIG. 5, DIG. 16, 132, 368, 370, 367

[56] References Cited

U.S. PATENT DOCUMENTS

| | | | |
|---|---|---|---|
| 3,689,437 | 9/1972 | McLaughlin | 252/557 |
| 3,835,058 | 9/1974 | White | 252/121 |
| 3,939,359 | 7/1976 | Lages | 252/107 |
| 4,100,097 | 7/1978 | O'Roark | 252/145 |
| 4,335,025 | 6/1982 | Barker et al. | 252/550 |
| 4,493,786 | 1/1985 | Joshi | 252/368 |
| 4,518,517 | 5/1985 | Eigen et al. | 252/107 |
| 4,557,853 | 12/1985 | Collins | 252/128 |
| 4,946,618 | 8/1990 | Knochel et al. | 252/117 |
| 4,963,284 | 10/1990 | Novakovic et al. | 252/108 |

FOREIGN PATENT DOCUMENTS

| | | | |
|---|---|---|---|
| 0015032 | 9/1980 | European Pat. Off. | 1/62 |
| 0350306 | 1/1990 | European Pat. Off. | 9/00 |
| 57030798 | 7/1980 | Japan | 09/02 |

*Primary Examiner*—Dennis Albrecht
*Attorney, Agent, or Firm*—Betty J. Zea; Leonard Williamson; Robert B. Aylor

[57] ABSTRACT

Aerated and/or freezer soap bar compositions which contain a substantial amount of sucrose have improved processability, improved physical and/or improved skin mildness characteristics.

5 Claims, No Drawings

AERATED AND FREEZER BAR SOAP COMPOSITIONS CONTAINING SUCROSE AS A MILDNESS AID AND A PROCESSING AID

TECHNICAL FIELD

This invention relates to aerated and freezer bar soap compositions.

BACKGROUND OF THE INVENTION

This invention relates to aerated and/or freezer bar soap compositions, e.g., of the type disclosed in U.S. Pat. No. 3,835,058, White, issued Sep. 10, 1974, incorporated herein by reference. U.S. Pat. No. 3,835,058 generally discloses a process for making a soap bar and soap bar compositions of the type found in this invention. The kinds and levels of many of the ingredients are similar, but the patent does not disclose either the use of sucrose or wax.

EPA 350,306, published Jan. 10, 1990, discloses a translucent detergent bar with 25–34 wt. % low soluble and insoluble soap plus 5–15 wt. % alcohol, 15–30 wt. % sugar and/or cyclic polyol plus 15–30% water. Examples sugars which are of cyclic polyols include sucrose, fructose and glucose. Aerated and freezer bar soaps are not mentioned.

U.S. Pat. No. 4,851,147, Esposito et al., issued Jul. 25, 1989, discloses a transparent soap bar containing up to 10% sugar. U.S. Pat. No. 4,518,517, Eigen et al., issued May 21, 1985, discloses a deodorant body cleansing composition containing mannose, glucose, and oligomers thereof. U.S. Pat. No. 3,969,259, Lages, issued Jul. 13, 1976, discloses sucrose as one of several transparency aids for a transparent soap bar.

U.S. Pat. No. 4,335,025, Barker et al., issued Jun. 15, 1982; U.S. Pat. No. 4,100,097, Roark, issued Jul. 11, 1978; U.S. Pat. No. 3,689,437, McLaughlin, issued Sep. 5, 1972; and EPA 0015032, Mansy, published Sep. 3, 1980, all incorporated herein by reference, disclose the use of paraffin wax in either milled or cast detergent or soap bars.

SUMMARY OF THE INVENTION

The present invention relates to the discovery that aerated or freezer bar soap compositions containing a substantial level of nonreducing sugar, e.g., sucrose, have improved mildness and/or improved processability.

DETAILED DESCRIPTION OF THE INVENTION

This invention relates to, e.g., aerated bar soap compositions of the type disclosed in U.S. Pat. No. 3,835,058, White, issued Sep. 10, 1974, incorporated herein by reference. Such aerated bar soap compositions containing sucrose are highly desirable from the standpoint of skin mildness and lathering and processability.

The aerated and/or freezer bar soap compositions of this invention contain:

(A) from about 25% to about 70%, preferably from about 35% to about 50%, and more preferably from about 40% to about 45%, of alkali metal and triethanolamine (TEA) fatty acid soap, and mixtures thereof, in which said fatty acid contains from about 8 to about 18, preferably from about 12 to about 18, carbon atoms;

(B) from about 5% to about 35%, preferably from about 10% to about 30%, of nonreducing sugar, preferably sucrose;

(C) from 0% to about 30%, preferably from about 2% to about 25%, more preferably from about 5% to about 20%, of hydrophobic/lipophilic soap bar additive material; the hydrophobic material is selected from the group consisting of: waxes; and other hydrophobic material, including free fatty acids; mono-, di-, and triglycerides; and fatty alcohols wherein the acyl and alkyl groups contain from about 8 to about 18 carbon atoms; and wherein the maximum of said wax is about 25%; and wherein the maximum of said other hydrophobic material is about 10% by weight of the bar; and (D) from about 15% to about 30%, preferably from about 20% to about 25%, water.

All parts, percentages and ratios herein are by weight unless otherwise specified.

The fatty acid component (A) suitable for use in the compositions and processes of the present invention include the water-soluble soaps normally used in bar soaps of the types disclosed herein. These include the triethanolamine (TEA) sodium and potassium ion soaps of higher fatty acids and mixtures thereof. The sodium soaps, particularly those derived from mixtures of coconut and tallow oils are preferred. Water-soluble soaps made from other fats or fatty acids can also be used as will be evident to those skilled in the art.

The soaps of the present invention normally contain from 8 to 18, preferably from about 12 to about 18, carbon atoms. Commercial soaps preferred herein are generally based upon mixtures of fatty acids obtained from various natural sources. Coconut oil, for example, is a material which has found considerable use in high-quality soap compositions. Similarly, tallow and palm oil stearin are useful sources of high-quality soaps. Other suitable sources include palm kernel oil and babassu kernel oil which are included within the term "coconut oil", olive oil and synthetic fatty acids simulating, for example, tallow. Particularly useful herein are the sodium and potassium salts of the mixtures of fatty acids derived from coconut oil (CN) or palm kernel oil (PKO) and tallow (T) and/or palm oil stearin (POS), e.g., sodium or potassium tallow and coconut soaps. Preferred soap mixtures are the tallow/(coconut or palm kernel oil) soaps ranging in proportions from 80:20 to 50:50 by weight. These soap mixtures are preferred from the standpoint of ready availability, ease of processing and their desirably optimum physical and performance characteristics.

The term "coconut" as used herein in connection with soap or free fatty acid mixtures refers to materials having an approximate carbon chain length distribution of: 8% $C_8$; 7% $C_{10}$; 48% $C_{12}$; 17% $C_{14}$; 9% $C_{16}$; 2% $C_{18}$; 7% oleic and 2% linoleic (the first six fatty acids being saturated).

The term "palm oil stearin" as used herein refers to materials having an approximate carbon chain length distribution of about: 1% $C_{14}$, 58% $C_{16}$, 5% $C_{18}$, 29% oleic, and 7% linoleic (the first three fatty acids being saturated).

The term "tallow" as used herein refers to a mixture of soaps having an approximate chain length distribution of: 2.5% $C_{14}$; 29% $C_{16}$; 23% $C_{18}$; 2% palmitoleic; 41.5% oleic and 3% linoleic (the first three fatty acids being saturated).

The (B) component of the present invention is a nonreducing sugar, e.g., sucrose. The nonreducing sugar is used at a level of from about 5% to about 35% and replaces at least a comparable amount of soap. The net effect of less soap in this case is a corresponding mildness benefit, as well as an unexpected processing benefit.

Sucrose will not reduce Fehling's solution and therefore is classified as a "nonreducing" disaccharide. Sucrose, commonly known as table sugar, is by far the most abundant carbohydrate found in the sap of land plants. It is one of the few nonreducing sugars available in a state of unexcelled purity, in highly crystalline form, on a very large scale, and at low cost. It has been produced since 2000 B.C. from the juice of the sugar cane and since the early 1800's from the sugar beet. Sucrose is a sweet, crystalline (monoclinic) solid which melts at 160°-186° C., depending on the solvent of crystallization.

Unless otherwise specified, the term "sucrose" as used herein includes sucrose, its derivatives, and similar nonreducing sugars and similar polyols which are substantially stable at a soap processing temperature of up to about 210° F. (98° C.), e.g., trialose, raffinose, and stachyose; and sorbitol, lactitol and maltitol.

In contrast, starch, a complex sugar, is a reducing sugar and turns brown or "burns" at the typical soap processing pH and/or temperature. It is important for the preferred execution of the present invention to have a pumpable, stable soap mix which turns pure white upon aeration to provide a white soap bar that floats. Starch increases the viscosity of the soap mix.

The sucrose has an unexpectedly dramatic thinning effect on the soap mix which eliminates the need to add excess water or solvent for homogeneous mixing. Sucrose reduces the viscosity profile of the soap mix that goes into the freezer at comparable shear rates by about 20% up to about 99%. Preferably, the amount of sucrose used to replace a comparable amount of soap would decrease the viscosity of an otherwise comparably dried soap bar mix by at least 50%, and more preferably by at least 75%.

When the soap/sucrose mix is homogeneous, it is then cooled in a freezer to a temperature of from at least about 49° C. to about 66° C. Again, the soap/sucrose mix is still pumpable and has a viscosity which does not require extraordinary equipment or excess water or excess solvent. The use of excess water/solvent requires an additional step for drying. Preferably, no moisture reduction (drying) step is required. The soap/sucrose mixes are formulated without excess water so that they are mixable and pumpable. The mixing temperature is typically from about 82° C. to about 100° C. The sucrose/soap composition crutcher mix, upon cooling, is used to make firm, stamped bars which stand up on a freezer process belt.

Alternatively, the sucrose can be added to a dried soap mix and still reduce its viscosity and provide a mildness benefit for the final bar. A "dried soap mix" is a mix wherein the water level has been reduced.

The third component (C) of the present invention is a hydrophobic material. The hydrophobic material of this invention is selected from: waxes; and other hydrophobic material such as mono-, di-, and triglycerides; fatty acids; fatty alcohols; and similar materials. Preferably the bars contain at least 3% wax and the ratio of wax to other hydrophobic material is from about 25:1 to about 1:3, more preferably from about 1:1 to about 10:1. This third component (C) is highly preferred, but soap/sucrose bars of the present invention can be made with little, or no, hydrophobic material.

However, soap and syndet/soap bars without sucrose can benefit from hydrophobic material, particularly the waxes. Thus, an aerated bar soap composition comprising:

(A) from about 25 wt. % to about 70 wt. % of alkali metal fatty acid soap in which said fatty acids contain from about 8 to about 18 carbon atoms;

(B) from about 0% to about 35% of a nonreducing sugar;

(C) from 3 wt. % to about 30 wt. % of hydrophobic material selected from the group consisting of waxes; free fatty acids containing from about 8 to about 18 carbon atoms; mono-, di-, and triglycerides; fatty alcohols containing from about 8 to about 18 carbon atoms; and mixtures thereof; and wherein said composition contains at least about 3% of said wax; and wherein said wax and said other hydrophobic materials have a ratio of from about 25:1 to about 1:3; and (D) from about 15% to about 25% water, is a preferred bar of this invention.

The hydrophobic material can be present in the bars of this invention at a level up to about 30%, but is preferably used at a level of from about 5% to about 20%. The levels of some hydrophobic materials, e.g., fatty acids, can be increased in the bar soap composition as the amount of sucrose is increased. The higher the amount of sucrose present, the more of such hydrophobic material can be present. Triglycerides ($C_8$-$C_{18}$ acyl chain) can be used up to about 10% without adversely affecting lather performance. The preferred and exemplified bars of the present invention have good lathering properties equal to the industry standard aerated freezer bar soap IVORY®.

The preferred hydrophobic material is a wax having a melting point (M.P.) of from about 120° F. to about 185° F. (49°-85° C.), preferably from about 125° F. to about 175° F. (52°-79° C.). A preferred paraffin wax is a fully refined petroleum wax having a melting point ranging from about 130° F. to about 140° F. (49°-60° C.). This wax is odorless and tasteless and meets FDA requirements for use as coatings for food and food packages. Such paraffins are readily available commercially. A very suitable paraffin can be obtained, for example, from The Standard Oil Company of Ohio under the trade name Factowax R-133.

Other suitable waxes are sold by the National Wax Co. under the trade names of 9182 and 6971, respectively having melting points of 131° F. and 130° F. (~55° C.).

The paraffin preferably is present in the bar in an amount ranging from about 5% to about 20% by weight. The paraffin ingredient is used in the product to impart skin mildness, plasticity, firmness, and processability. It also provides a glossy look and smooth feel to the bar.

The paraffin ingredient is optionally supplemented by a microcrystalline wax. A suitable microcrystalline wax has a melting point ranging, for example, from about 140° F. (60° C.) to about 185° F. (85° C.), preferably from about 145° F. (62° C.) to about 175° F. (79° C.). The wax preferably should meet the FDA requirements for food grade microcrystalline waxes. A very suitable microcrystalline wax is obtained from Witco Chemical Company under the trade name Multiwax X-145A. The microcrystalline wax preferably is present in the bar in an amount ranging from about 0.5% to about 5% by weight. The microcrystalline wax ingredient imparts pliability to the bar at room temperatures.

Fatty acids are preferably used in the process of the invention. Preferred are those having from 8 to 18 carbon atoms. Normally a mixture of free fatty acids derived from natural sources is employed. Preferred mixtures of fatty acids are the coconut/tallow fatty acid mixtures hereinbefore described. As discussed hereinbefore, the level of trans fatty acids should be minimized. The level of trans fatty acids is increased when the fatty acids are "hardened", e.g., by hydrogenation, so simply hydrogenating to a lower degree is a convenient way to obtain the desired fatty acids.

The free fatty acids improve the quantity and quality of the lathering characteristics of bars prepared in accordance with the process of the present invention. The advantage of free fatty acids in tending to provide a lather of desirable stability and having small air bubbles so as to provide a rich or creamy lather has been known in the art. Fatty acids also provide an emollient effect which tends to soften the skin or otherwise improve feel-on-skin characteristics and scavenge any excess alkalinity.

The amount of free fatty acid incorporated into the preferred finished bars of the invention ranges from about 0.5% to about 8%. A preferred amount of fatty acid ranges from about 2% to about 6%.

The free fatty acid can be incorporated into bars of the present invention in a number of suitable ways. The free fatty acid component is desirably incorporated into the soap mixture either prior to, or simultaneously with, the high-shear mixing step used to form the bar composition. Uniform distribution of the free fatty acid throughout the finished bar composition is facilitated by the high-shearing action. The free fatty acid component can be added subsequent to the high-shear mixing step if other subsequent mixing means are employed so as to substantially uniformly distribute the free fatty acid throughout the soap mixture or resulting bar composition.

The free fatty acid component is preferably introduced into the soap mixtures of the present invention by addition of the free fatty acid to the soap mixture in the initial crutching stage. Alternatively, the free fatty acid component can be introduced prior to or during the aeration stage where perfume and other additives, if desired, are incorporated into the soap mixture. The free fatty acid component can also be introduced as a prepared mixture of soap and free fatty acid, such as an acid-reacting mixture of soap and free fatty acid prepared by under-neutralization in the soap making process.

The bars of this invention can show a mildness improvement without free fatty acids as the result of the presence of the sucrose alone or the sucrose used in combination with some other hydrophobic material.

The fourth component (D) of the present invention is water. The level of water in the bar can range from about 10% to about about 30%, preferably from about 15% to about 25%. Higher levels of water within these preferred ranges are preferred for mildness and cost reduction. Excess amounts of water can be used in a process for making the bars of this invention; but, the excess water should be removed prior to the addition of the sucrose to avoid burning (degrading) the sucrose in the 300° F. (149° C.) drying step. In the preferred aerated freezer bar process, the amount of water used does not require a drying step.

It should be noted that in frame bar processes higher levels of water can be used because the bars are not required to stand up (hold their shape) upon extrusion.

The bar soap compositions of the present invention can contain other additives commonly included in toilet bars such as perfumes, other fillers, sanitizing or antimicrobial agents, dyes, and the like. The preferred bar of this invention contains from about 3% to about 5% calcium carbonate. These additives make the finished bar compositions either more attractive or effective without detracting from the desirable attributes of the bar.

The bar compositions of the present invention can additionally contain a water-soluble organic nonsoap synthetic detergent, preferably, at a level of from about 2% to about 15% by weight of the bar. Normally the soap/synthetic bars are prepared to contain a ratio of soap to synthetic detergent of from about 3:1 to about 25:1. The choice of suitable ratios will depend upon the particular synthetic detergent, the desired performance and physical characteristics of the finished bar, temperature, moisture and like processing considerations. A preferred ratio is from about 4:1 to about 7:1.

The synthetic detergent constituent of the bar compositions of the invention can be designated as being a detergent from the class consisting of anionic, nonionic, ampholytic and zwitterionic synthetic detergents. Examples of suitable synthetic detergents for use herein are those described in U.S. Pat. No. 3,351,558, Zimmerer, issued Nov. 7, 1967, at column 6, line 70 to column 7, line 74, incorporated herein by reference.

Preferred herein are the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm kernel oil, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

Preferred sulfonate detergents include the alkyl glyceryl ether sulfonate detergents (i.e., water-soluble salts of alkyl glyceryl ether sulfonic acid) having from 10 to 18 carbon atoms in the alkyl group. The alkyl glyceryl ether sulfonates are described in greater detail in U.S. Pat. No. 2,989,547, Whyte, issued Jun. 20, 1961.

THE PROCESSING

The addition of sucrose to an aerated or a freezer soap bar process surprisingly results in a more processable soap mix which does not require drying (moisture reduction), as required in the prior art freezer process of U.S. Pat. No. 3,835,058, supra, incorporated herein by reference.

A preferred process for making aerated freezer bars of the present invention comprises the following steps:

I. Mixing a soap composition comprising:

(A) from about 25 wt. % to about 70 wt. % of alkali metal fatty acid soap in which said fatty acids contain from about 8 to about 18 carbon atoms;

(B) from about 5% to about 35% of sucrose;

(C) from 0 wt. % to about 30 wt. % of hydrophobic material selected from waxes and free fatty acids, mono-, di-, and triglycerides; and fatty alcohols containing from about 8 to about 18 carbon atoms; and mixtures thereof; and (D) from about 10% to about 30%, preferably from about 15% or 20% to about 25%, water;

wherein said composition has a mixing temperature of from about 82° C. to about 102° C. (from about 100° F. to about 212° F.); and wherein, if and when said mix is dried to reduce the amount of said water, said (B) sucrose is added after said drying;

II. Aerating said mix;

III. Cooling the mix to a temperature of from about 49° C. to about 66° C. (from about 120° F. to about 150° F.); and IV. Forming aerated bars (plugs) from said cooled and aerated mix.

A process for making a non-aerated soap bar from the composition comprises the steps of:

1. Mixing said (A), (B), (C), and (D) at a temperature of from about 82° C. to about 102° C. (180° F. to about 215° F.);
2. Cooling said mix of Step I. to a temperature of from about 49° C. to about 60° C. (120° F. to about 160° F.); and
3. Forming said non-aerated bars from said cooled mix.

The mixing temperatures can range from about 215° F. (102° C.) to about 180° F. (82° C.), preferably about 85° C. to about 95° C., and can be cooled to a temperature of from about 120° F. (49° C.) to at least about 150° F. (66° C.), preferably about 50° C. to about 60° C., depending on the particular formulation. Preferably, the formed soap bars (plugs) of Step IV. are formed from a mix which is cooled sufficiently to provide free standing bars (plugs). The preferred process does not require a moisture reduction step. The plugs are preferably formed via an extrusion operation, as shown in U.S. Pat. No. 3,835,058, supra.

Although freezer bars are preferred, aerated bars of the present invention can also be made using a cast (frame) bars process. While aerated bars are preferred, the unique soap/sucrose bar soap compositions of the present invention can also be used to make unique non-aerated freezer bars. Such non-aerated freezer bar soap compositions preferably contain less than 5% of organic solvents, e.g., alcohols, etc. Preferably they contain less than 3% of such organic solvents and more preferably from 0% to less than about 1% of such organic solvents. Again, the preferred process does not have a drying step.

Again, it is an important advantage that the preferred soap bar composition of the present invention in a freezer bar process is such that the formed bars (plugs) can stand up on the belt in the continuous freezer bar process. It should be noted that cast bar compositions which use higher levels of water and/or organic solvent, e.g., 40% water, will not hold their forms or stand up on a freezer bar belt. Similarly, bars which depend on the formation of large detergent, or soap, crystals to set up will not stand up on the belt. In sharp contrast, the formed freezer bars (plugs) of the present soap/sucrose invention hold their forms and stand up on the belt. In the freezer step, lowering the temperature of the composition by from about 15° C. to about 50° C., preferably from about 20° C. to about 40° C., is sufficient to create a dimensionally stable plug that does not slump while being processed. Needless to say, the elimination of a costly and time consuming moisture or solvent reducing (drying) step in a freezer bar process or a cast bar process is an advantage which was completely unexpected and surprising. See the Figure of U.S. Pat. No. 3,835,058, supra, for a schematic drawing of a prior art continuous freezer soap bar making process with a moisture reducing step.

The following examples illustrate the practice of this invention. All percentages, parts and ratios herein are by weight unless otherwise specified. The free fatty acids used in the examples are used at about the same ratio as the fatty acid soaps. The soaps are made in situ, unless otherwise specified.

The soap bar compositions of Examples 1-6 are mixed at a temperature of about 190° F. (88° C.) and pumped into a scraped wall heat exchanger where the temperature of the mix is cooled to about 130° F. (55° C.) and where the mix is aerated. The aerated and cooled soap mix is then extruded and bar plugs are cut and conditioned. The final bars are then stamped.

EXAMPLE 1

| EXAMPLE 1 | |
|---|---|
| Ingredient | Wt. % |
| Na Tallowate | 39.05 |
| Na Cocoate | 13.02 |
| Water | 22.00 |
| Sucrose | 20.00 |
| Free Fatty Acid | 3.00 |
| Sodium Chloride | 0.50 |
| Perfume | 0.16 |
| Mg $SO_4$ | 0.14 |
| Sodium Silicate | 0.14 |
| Sodium Citrate | 2.00 |
| Total | 100.00 |

| EXAMPLE 2 | |
|---|---|
| Ingredient | Wt. % |
| Na Tallowate | 28.73 |
| Na Cocoate | 9.58 |
| K Tallowate | 3.19 |
| K Cocoate | 1.06 |
| Water | 22.00 |
| Sucrose | 25.00 |
| Free Fatty Acid | 4.00 |
| Sodium Chloride | 1.00 |
| Perfume | 0.16 |
| Mg $SO_4$ | 0.14 |
| Sodium Silicate | 0.14 |
| $CaCO_3$ (6 microns) | 4.00 |
| Sodium Citrate | 1.00 |

-continued

| EXAMPLE 2 | |
|---|---|
| Ingredient | Wt. % |
| Total | 100.00 |

| EXAMPLE 3 | |
|---|---|
| Ingredient | Wt. % |
| Na Tallowate | 28.73 |
| Na Cocoate | 9.58 |
| K Tallowate | 3.19 |
| K Cocoate | 1.06 |
| Water | 22.00 |
| Sucrose | 17.00 |
| Paraffin 9182 (M.P. ~55° C.) | 8.00 |
| Free Fatty Acid | 4.00 |
| Sodium Chloride | 1.00 |
| Perfume | 0.16 |
| Mg $SO_4$ | 0.14 |
| Sodium Silicate | 0.14 |
| $CaCO_3$ | 4.00 |
| Sodium Citrate | 1.00 |
| Total | 100.00 |

| COMPARATIVE TEA BAR X | |
|---|---|
| Ingredient | Wt. % |
| Na Soap 80/20 T/C | 30.0 |
| TEA Soap 80/20 T/C | 30.0 |
| Glycerine | 10.0 |
| Water | 5.5 |
| Free TEA | 15.0 |
| Nonionic Surfactants* | 8.4 |
| Perfume | 1.0 |
| Miscellaneous | 0.1 |
| Total | 100.0 |

*Laneth-10-Acetate; Nonoxynol-14

| EXAMPLE 4 | |
|---|---|
| Ingredient | Wt. % |
| Na Tallowate | 30.89 |
| Na Cocoate | 10.30 |
| K Tallowate | 1.63 |
| K Cocoate | 0.54 |
| Water | 22.00 |
| Sucrose | 22.00 |
| Free Fatty Acid | 6.00 |
| Sodium Chloride | 1.20 |
| Perfume | 0.16 |
| Mg $SO_4$ | 0.14 |
| Sodium Silicate | 0.14 |
| $CaCO_3$ | 5.00 |
| Total | 100.00 |

| EXAMPLE 5 | |
|---|---|
| Ingredient | Wt. % |
| Na Tallowate | 42.60 |
| Na Cocoate | 14.20 |
| Water | 30.26 |
| Sucrose | 10.00 |
| Free Fatty Acid | 2.00 |
| Sodium Chloride | 0.50 |
| Perfume | 0.16 |
| Mg $SO_4$ | 0.14 |
| Sodium Silicate | 0.14 |
| Sodium Citrate | 2.00 |
| Total | 100.00 |

| EXAMPLE 6 | |
|---|---|
| Ingredient | Wt. % |
| Na Tallowate | 28.39 |
| Na Cocoate | 9.46 |
| K Tallowate | 3.15 |
| K Cocoate | 1.06 |
| Water | 23.00 |
| Sucrose | 18.00 |
| Free Fatty Acid | 4.00 |
| Sodium Chloride | 0.50 |
| Perfume | 0.16 |
| Mg $SO_4$ | 0.14 |
| Sodium Silicate | 0.14 |
| $CaCO_3$ | 4.00 |
| Palm Oil Stearin Triglyceride | 8.00 |
| Total | 100.00 |

The viscosities of the soap/sucrose mix formulas of Examples 1-6 are such that they are homogenously mixable and pumpable at the processing temperature. The crutcher mixes of the formulations of Examples 1-6 are mixed at a temperature of about 83° C. The mixes are cooled to a temperature of about 130° F. (55° C.), extruded and cut into plugs, which plugs stand up on the freezer belt without losing their shapes. The plugs are further conditioned (allowed to stand for some time) and are then stamped into finished bars. No moisture reduction step is used. Example 5 was the softest, probably due to its higher moisture level, but makes a very fine cast bar. All of the exemplified bars of the present invention have good lathering properties equal to the industry standard aerated freezer bar soap IVORY®. Examples 1-6 are significantly milder than commercial IVORY® bar soap, and are about as mild as a very mild TEA soap bar (Bar X).

The bar of Example 3 containing 8% paraffin wax (M.P. ~55° C.) is milder than the bars of Examples 1 and 2, and is as mild as the standard mild comparative TEA bar X. It is believed that the paraffin wax improves mildness as indicated by preventing excess drying of the skin.

| COMPARATIVE EXAMPLE Y | |
|---|---|
| Ingredient | Wt. % |
| Na Tallowate | 56.82 |
| Na Cocoate | 18.94 |
| Water | 23.00 |
| Sodium Chloride | 0.80 |
| Perfume | 0.16 |
| Mg $SO_4$ | 0.14 |
| Sodium Silicate | 0.14 |
| Total | 100.00 |

Comparative Example Y is a dried soap mix formula made from a 30% water neat soap. As shown in Table 1 below, at 30% water, the "Y" soap mix has a viscosity profile at shear rates of 200 (1,051 cps) and 0.3 (161,254 cps) sec.$^{-1}$. When dried, "Y" contains 23% water and has a viscosity profile at the mixing temperature of about 184° F. (84° C.) and at shear rates of 43 (28,763 cps) and 0.3 (1,165,807 cps) sec.$^{-1}$. The viscosity profile of dried soap mix "Y" is compared to the estimated viscosity profile of Example 2, which contains 25% sucrose and 22% water.

TABLE 1

| | Viscosity, cps, Neat Soap Ex. Y | Viscosity, cps, Dried Soap Ex. Y | Viscosity, cps, Ex. 2 | % Reduction of Viscosity |
|---|---|---|---|---|
| Lowest Shear[1] | 161,254 | 1,165,807 | N/A | — |
| Low Shear[2] | 4,810 | 37,551 | 2,280 | 94% |
| Moderate Shear[3] | 2,752 | 28,763 | 1,141 | 96% |
| High Shear[4] | 1,051 | N/A | 433 | — |
| Viscometer | Haake Rotovisco 12 Drive 500 System SVII | Haake Rotovisco 12 Drive 500 System SVII | Contraves Rheomat 108E Sleeve 1 Bob 2 | |

[1]Approximate shear rate, 0.3/sec.
[2]Approximate shear rate, 17/sec.
[3]Approximate shear rate, 43/sec.
[4]Approximate shear rate, 200/sec.

The Comparative bar of Example Y has about 33% more soap than Example 2 which uses 33% of selected materials: 25% sucrose, 4% free fatty acid; and 4% calcium carbonate. Note that the percent reduction of viscosity $$\frac{Y - \text{Ex. 2}}{Y} \times 100$$

at the comparable low and moderate shears are 94% and 96%. In other words, the viscosity of the dried soap mix is reduced by about 95% when 25% soap is replaced with sucrose.

EXAMPLE 7

| Ingredient | Wt. % |
|---|---|
| Na Tallowate | 28.73 |
| Na Cocoate | 9.58 |
| K Tallowate | 3.19 |
| K Cocoate | 1.06 |
| Water | 23.00 |
| Sucrose | 10.00 |
| Free Fatty Acid | 4.00 |
| Sodium Chloride | 1.00 |
| Perfume | 0.16 |
| Mg $SO_4$ | 0.14 |
| Sodium Silicate | 0.14 |
| $CaCO_3$ | 4.00 |
| 9182 Paraffin | 15.00 |
| Total | 100.00 |

All of the bars 1-7 are aerated bars. They have good lather equal to the standard IVORY® soap bar. Bar 7 is made by an aerated soap bar cast process. Bars 1-6 are made using a continuous freezer process. Excellent cast bars are also made using the formulas of Examples 1-6. All of the Bars 1-7 are IVORY® white in color.

EXAMPLE 8

An excellent non-aerated freezer bar is made using the formula of Example 3.

EXAMPLE 9

An excellent cast bar is made as in Example 7, except that the bar is not aerated.

COMPARATIVE EXAMPLE Z

A bar is made using a formulation similar to Example 1, but an unmodified corn starch (sold under the trade name of Amaizo 100 by American Maize Co.) is used instead of sucrose. Starch is a reducing complex sugar. The soap/starch mix requires 8% excess water and a subsequent 149° C. moisture reduction (drying) step. Also, the final aerated soap bar has a brownish color because the starch degraded at the mixing temperature of 190° F. (88° C.) and the drying temperature of 300° F. (149° C.).

It should be noted that a reducing sugar will turn the bar brown, even without a drying step. The browning of the bar is also associated with an off odor problem.

EXAMPLE 10

| Ingredient | Wt. % |
|---|---|
| Na Tallowate | 35.48 |
| Na Cocoate | 11.83 |
| K Tallowate | 3.94 |
| K Cocoate | 1.31 |
| Water | 23.00 |
| Free Fatty Acid | 4.00 |
| Sodium Chloride | 1.00 |
| Perfume | 0.16 |
| Mg $SO_4$ | 0.14 |
| Sodium Silicate | 0.14 |
| $CaCO_3$ | 4.00 |
| Paraffin (M.P. ~55° C.) | 15.00 |
| Total | 100.00 |

Aerated bars made from the above formulation contain 15% paraffin wax. No sucrose is used. The mix has a slippery look in the mixing vessel and the finished bar has good lather and excellent mildness properties.

What is claimed is:

1. A process for making an aerated freezer soap bar comprising the steps of:

I. Mixing a soap bar composition comprising:

(A) from about 25 wt. % to about 70 wt. % of alkali metal fatty acid soap in which said fatty acids contain from about 8 to about 18 carbon atoms;

(B) from about 5 wt. % to about 35 wt. % of sucrose;

(C) from about 3 wt. % to about 20 wt. % of a hydrophobic material selected from waxes, free fatty acids and fatty alcohols containing from about 8 to about 18 carbon atoms and wherein said composition contains at least about 3 wt. % of said wax; and (D) from about 10 wt. % to about 30 wt. % water; wherein said composition does not contain an effective amount of water-soluble organic non-soap synthetic detergent; at a temperature of from about 82° C. to about 100° C. (from about 180° F. to about 212° F.); said mix being fluid, substantially homogeneous, and pumpable;

II. Aerating said mix;

III. Cooling said mix to a temperature of from about 49° C. to about 66° C. (from about 120° F. to about 160° F.); and IV. Forming aerated bars from said aerated and cooled mix, wherein said process does not include a moisture reduction drying step.

2. The process of claim 1 wherein said aerated and cooled bars are free standing and wherein said temperature of Step I. is from about 85° C. to about 95° C. and said cooling temperature is from about 50° C. to about 60° C.

3. The process of claim 1 wherein said process is continuous and said water content of said mix and said aerated bars is from about 20 wt. % to about 25 wt. %.

4. A process for making a non-aerated soap bar from the composition of comprising:

(A) from about 25 wt. % to about 70 wt. % of alkali metal fatty acid soap in which said fatty acids contain from about 8 to about 18 carbon atoms;

(B) from about 5 wt. % to about 35 wt. % of a nonreducing sugar;

(C) from about 3 wt. % to about 30 wt. % of hydrophobic material selected from the group consisting of waxes; free fatty acids containing from about 0 to about 10 carbon atoms; mono-, di-, and triglycerides; fatty alcohols containing from about 8 to about 18 carbon atoms and wherein said composition contains at least about 3 wt. % of said wax; and mixtures thereof; and (D) from about 15 wt. % to about 25 wt. % water; wherein said composition does not contain an effective amount of water-soluble organic non-soap synthetic detergent;

wherein said process comprises the steps of:

1. Mixing said (A), (B), (C), and (D) at a temperature of from about 82° C. to about 102° C. (180° F. to about 215° F.);
2. Cooling said mix of Step I. to a temperature of from about 49° C. to about 60° C. (120° F. to about 160° F.); and
3. Forming said non-aerated bars from said cooled mix, wherein said process does not include a moisture reduction drying step.

5. The process of claim 4 wherein said process is continuous.

* * * * *